US010514009B2

(12) United States Patent
Fukui et al.

(10) Patent No.: US 10,514,009 B2
(45) Date of Patent: Dec. 24, 2019

(54) FUEL SUPPLY DEVICES

(71) Applicant: AISAN KOGYO KABUSHIKI KAISHA, Obu-shi, Aichi-ken (JP)

(72) Inventors: Tatsuki Fukui, Nagoya (JP); Koji Yoshida, Kasugai (JP); Takuya Kono, Nagoya (JP); Shinya Higashi, Kasugai (JP); Yuichi Murakoshi, Inazawa (JP); Takayuki Kondo, Inazawa (JP); Akihiro Yano, Obu (JP); Kensuke Niwa, Nagoya (JP); Hidetomo Ishida, Nagoya (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 531 days.

(21) Appl. No.: 15/506,230

(22) PCT Filed: Aug. 10, 2015

(86) PCT No.: PCT/JP2015/072657
§ 371 (c)(1),
(2) Date: Aug. 8, 2017

(87) PCT Pub. No.: WO2016/031543
PCT Pub. Date: Mar. 3, 2016

(65) Prior Publication Data

US 2017/0328318 A1 Nov. 16, 2017

(30) Foreign Application Priority Data

Aug. 26, 2014 (JP) ..... 2014-171443

(51) Int. Cl.
*F02M 37/10* (2006.01)

(52) U.S. Cl.
CPC ..... *F02M 37/106* (2013.01)

(58) Field of Classification Search
CPC ..... F02M 37/103; F02M 37/106; F02M 37/10
See application file for complete search history.

(56) References Cited

U.S. PATENT DOCUMENTS

| | | | |
|---|---|---|---|
| 6,716,000 | B2 | 4/2004 | Appleton et al. |
| 7,159,576 | B2 | 1/2007 | Yamashita et al. |

FOREIGN PATENT DOCUMENTS

| | | | |
|---|---|---|---|
| CN | 1365427 | A | 8/2002 |
| JP | 2006-152992 | A | 6/2006 |
| JP | 2006-342678 | A | 12/2006 |

(Continued)

OTHER PUBLICATIONS

Chinese Office Action dated Aug. 15, 2018 for Chinese Application No. 201580045416.8 (6 p.).

(Continued)

*Primary Examiner* — Xiao En Mo
(74) *Attorney, Agent, or Firm* — Conley Rose, P.C.

(57) ABSTRACT

A fuel supply device includes a cover member which is attached to an opening of a fuel tank, a pump unit comprising a pump, and a connecting portion for connecting the cover member and the pump unit. The pump unit is connected to the connecting portion so as to be relatively movable to the cover member. When the fuel supply device is attached to the fuel tank, an engagement portion provided at a lower portion of the pump unit abuts the connecting portion such that via the engagement portion the connecting portion presses the pump unit against the fuel tank.

15 Claims, 8 Drawing Sheets

(56) References Cited

FOREIGN PATENT DOCUMENTS

| | | | |
|---|---|---|---|
| JP | 2009-209842 | A | 9/2009 |
| JP | 2012-184760 | | 9/2012 |
| JP | 2012-202231 | A | 10/2012 |

OTHER PUBLICATIONS

English Translation of Chinese Office Action dated Aug. 15, 2018 for Chinese Application No. 201580045416.8 (5 p.).
Japanese Office Action dated Jun. 12, 2017, for Japanese Application No. 2014-171443 (4 p.).
English Translation of Japanese Office Action dated Jun. 12, 2017, for Japanese Application No. 2014-171443 (4 p.).
International Patent Application No. PCT/JP2015/072657 International Search Report dated Sep. 29, 2015 (4 pages).

FUEL SUPPLY DEVICES

CROSS-REFERENCE TO RELATED APPLICATIONS

The present application is a National Phase entry of, and claims priority to, PCT Application No. PCT/JP2015/072657, filed Aug. 10, 2015, which claims priority to Japanese Patent Application No. 2014-171443, filed Aug. 26, 2014, both of which are incorporated by reference herein in their entireties for all purposes.

STATEMENT REGARDING FEDERALLY SPONSORED RESEARCH OR DEVELOPMENT

Not applicable.

BACKGROUND

The present invention relates to a fuel supply device. In particular, the subject matter relates to a fuel supply device for supplying fuel within a fuel tank to an internal combustion engine, wherein the fuel supply device is mounted to a vehicle, e.g. an automobile.

Fuel supply devices mounted to fuel tanks are widely known in the art. It is also widely known that a part of the fuel supply device can be inserted from an opening formed in an upper surface portion of the fuel tank, where the device attaches to said opening when the fuel supply device is mounted to the fuel tank. Further, as disclosed in a Japanese Laid-Open Patent Publication No. 2006-342678, it is also known to provide an engagement portion, which can abut an upper surface of a pump unit, at a lateral surface of a connecting portion of a fuel supply device.

BRIEF SUMMARY

However, the above prior art may still be further improved. A conventional fuel supply device is configured such that a pump unit is pressed against a bottom surface of the fuel tank by applying force to a lateral portion of an upper surface of the pump unit, as described in the Japanese Laid-Open Patent Publication No. 2006-342678. According to the conventional configuration, a pump unit 4 can be lifted from a bottom surface 73 of a fuel tank due to oscillation of a vehicle the fuel tank and device may be mounted to when a clearance is formed between the pump unit 4 and a connecting portion. Further, as also known in the prior art, one end of a pump unit could be lifted because the force is applied to a lateral portion of the upper end surface of the pump unit. In other words, the pump unit could be inclined relative to the bottom surface of a fuel tank to which a conventional fuel supply device may be mounted due to lateral force applied. Consequently, due to both of these factors residual fuel amount within the fuel tank would not be detected properly.

Therefore, there is a need for a fuel supply device configured such that it prevents a pump unit from being inclined or lifted relative to a bottom surface of a fuel tank due to applied lateral force as well as preventing lifting due to oscillations of a vehicle to which the fuel supply device may be mounted, by maintaining the pump unit in an abutted position in constant contact with the bottom surface of the fuel tank.

According to one aspect of the present invention, a fuel supply device comprises a cover member which is attached to an opening of a fuel tank, as well as a pump unit comprising a pump, and a connecting portion for connecting the cover member and the pump unit. The pump unit is connected to the connecting portion so as to be relatively movable with respect to the cover member. When the fuel supply device is assembled or attached to the fuel tank, an engagement portion provided at a lower portion of the pump unit abuts to the connecting portion such that via the engagement portion the connecting portion presses the pump unit against the fuel tank.

Therefore, the moment of inertia needed for rotating the pump unit is prevented from being generated. Accordingly, it is possible to maintain the pump unit being abutted to the bottom surface of the fuel tank.

According to another aspect of the present invention, the engagement portion includes a bottom surface which is formed in the same plane as a bottom portion of a suction portion formed as part of the pump unit.

Consequently, due to the described spatial configuration, the bottom portion of the suction portion at the bottom of the pump unit can also be maintained abutting the bottom surface of the fuel tank when the engagement portion abuts to the bottom surface of the fuel tank. As a result, the pump unit can abut to the bottom surface of the fuel tank in a stable state.

According to another aspect of the present invention, the engagement portion is integrally formed with a bottom portion of a suction portion provided at the pump unit.

Therefore, with an integral configuration, it is not necessary to provide an additional separate member for the engagement portion. In this manner, the fuel supply device may have a simplified configuration.

According to another aspect of the present invention, the pump unit can be connected so as to be relatively movable with respect to the connecting portion when a connecting shaft which is formed as part of one of the connecting portion or the pump unit, is inserted into the connecting hole which is formed as part of the other of the two. A planar surface and a curved surface having a circular arc shape in a side view are formed at a lower end of the connecting portion. The curved surface is formed at a corner of the lower end of the connecting portion, while the center of the circular arc of the curved surface corresponds to a central axis of the connecting hole.

Therefore, in this way, the engagement portion can be firmly pressed by the planar surface of the connecting portion. Further, because the curved surface is formed at the corner of the lower end of the connecting portion, the pump unit may be smoothly rotated around the center of the connecting shaft. Consequently, even if the fuel supply device is configured with a rotatable pump unit, the engagement portion may be smoothly pressed by the planar surface.

According to another aspect of the present invention, the engagement portion receives a pressing force from the connecting portion via a biasing member which is arranged directly above the planar surface, which biases the connecting portion.

Therefore, the biasing force from said biasing member can be efficiently utilized. For example, through the influence of the biasing force, the planar surface can press the pump unit against the bottom surface of the fuel tank where the biasing force from the biasing member is not changed in a rotational direction.

DETAILED DESCRIPTION

Figure 1:
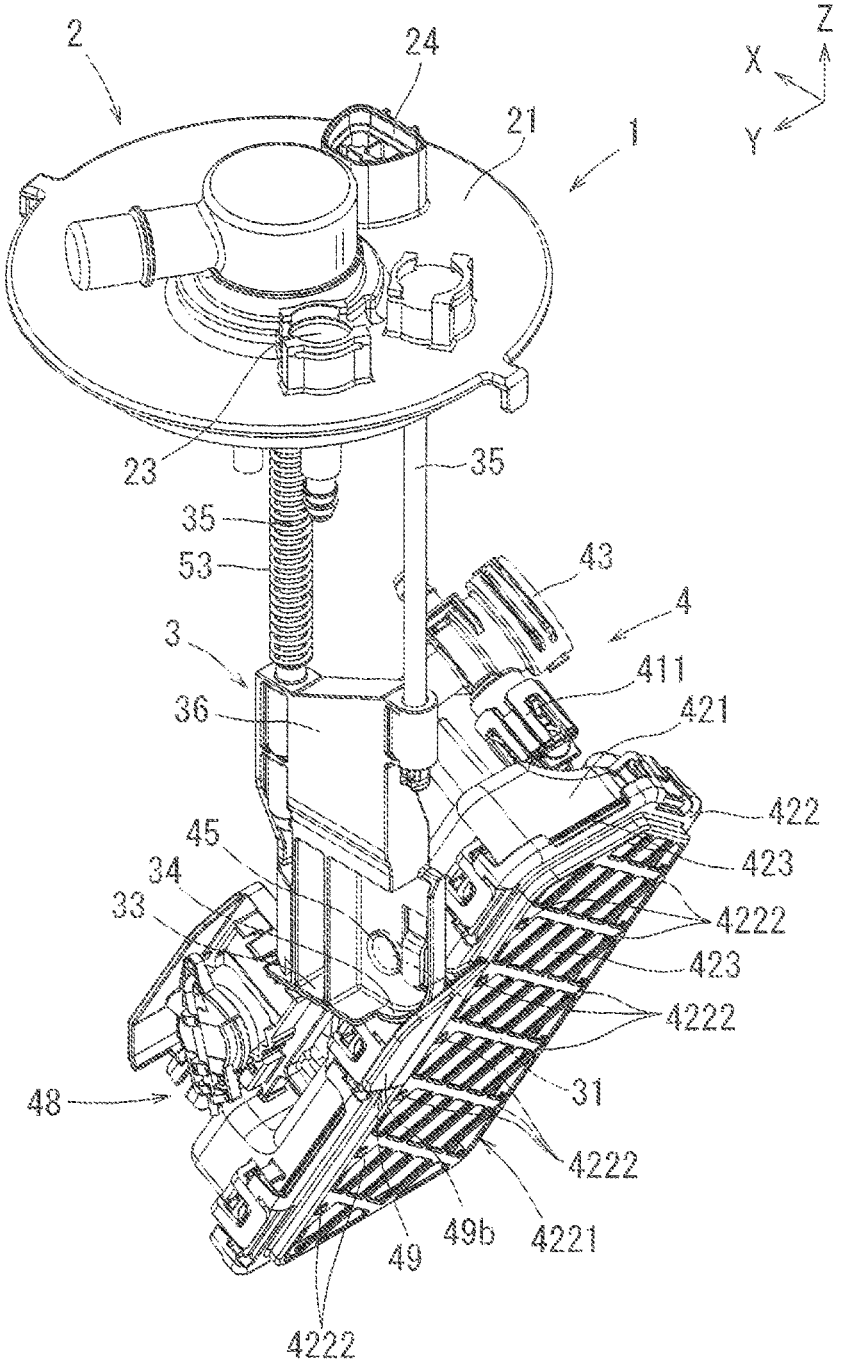
FIG. 1 is a perspective view of a fuel supply device according to one embodiment, which does not show a hose arranged between a pump and a protruding port.

Hereinafter, one exemplary embodiment of the present invention will now be described with reference to the drawings. The forward and backward directions, upward and downward directions as well as leftward and rightward directions in the present specification are determined such that X is a forward direction, Y is a leftward direction and Z is an upward direction as shown in FIG. 1, where the backwards, upwards, and downwards directions extend in the negative direction of X, Y, and Z, respectively. For example, generally a cover member 2 of a fuel supply device 1 is positioned at an upper side and a pump unit 4 is positioned at a lower side, below the cover member. A rotary axis of the pump unit 4 extends in the leftward and rightward directions. The forward and backward directions are orthogonal to the leftward and rightward directions as well as to the upward and downward directions.

The fuel supply device 1 according to the present embodiment may be mounted on a vehicle, such as an automobile. The fuel supply device 1 may be attached to a fuel tank 7 arranged below a floor of the vehicle. The fuel supply device 1 is used to feed liquid fuel stored within the fuel tank 7 to an internal combustion engine (not shown).

Figure 2:
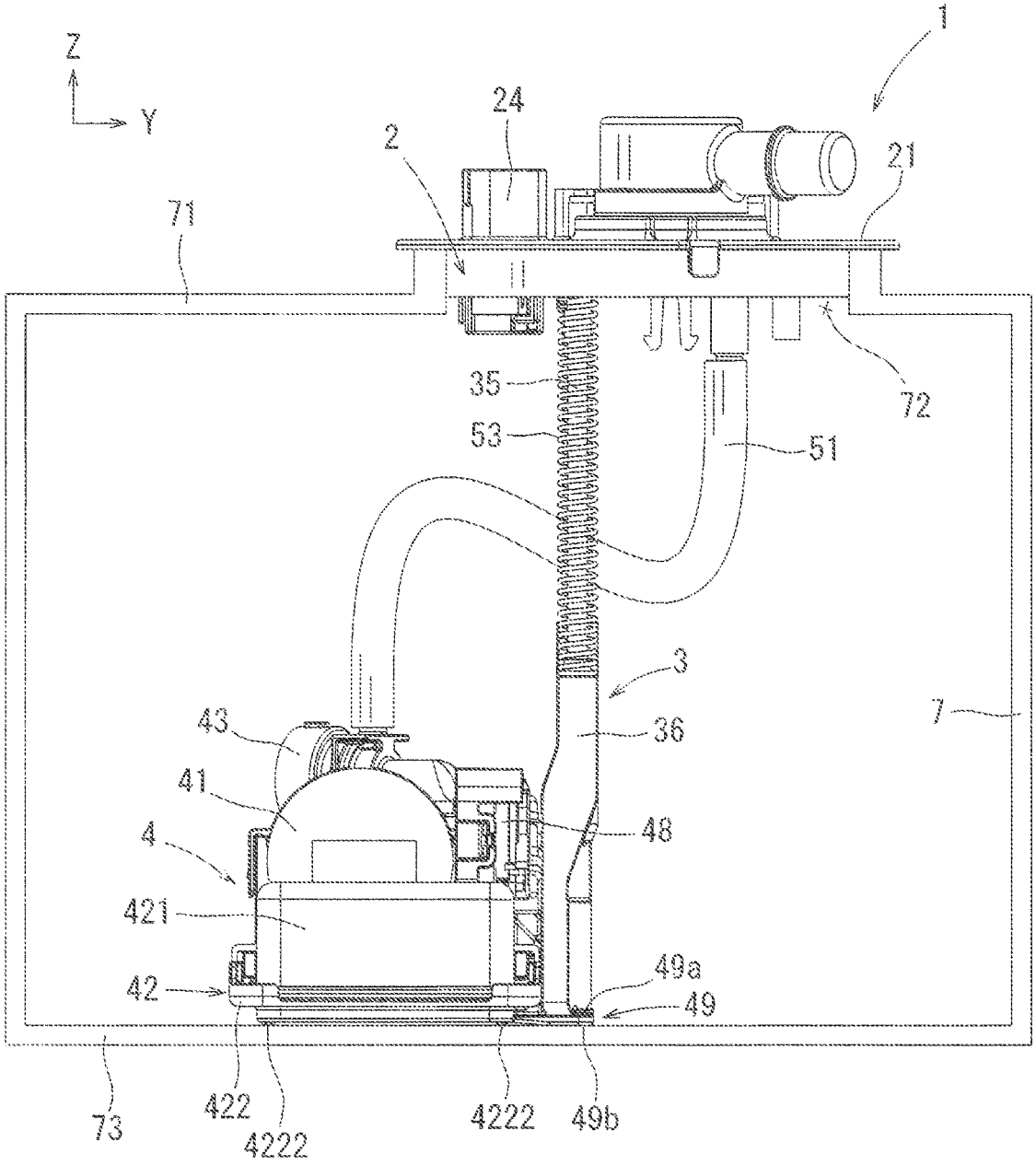
FIG. 2 is a front view of the fuel supply device of FIG. 1 attached to a fuel tank.

As shown in FIGS. 1 and 2, the fuel supply device 1 according to the present embodiment has the cover member 2 attached to an opening 72 formed within an upper surface portion 71 of the fuel tank 7, and a pump unit 4 with a pump 41 which may be used for feeding fuel within the fuel tank 7 to the outside. Further, the fuel supply device 1 includes a connecting portion 3 used for connecting the cover member 2 with the pump unit 4, and a fuel residual amount detection device 48 for detecting the residual amount of fuel stored in the fuel tank 7. The pump unit 4 is installed at a bottom surface 73 of the fuel tank 7 and the cover member 2 is attached to the opening 72 of the fuel tank 7. The cover member 2 can close the opening 72 of the fuel tank 7 and press the pump unit 4 in touching contact along the bottom surface 73 of the fuel tank 7.

As shown in FIGS. 1 and 2, the cover member 2 includes a set plate portion 21 which covers the opening 72 of the fuel tank 7. An outlet port 23 is provided on the substantially disk-shaped set plate 21 for leading fuel delivered from the pump unit 4 to the outside of the fuel tank 7. Further, the set plate portion 21 includes an electric connector 24 for connecting electric wiring. The opening 72 normally has a circular shape, and the set plate portion 21 has a substantially circular shape in plan view, which is concentric with and thus corresponds to the shape of the opening 72. A ring (not shown) made of resin is attached to the opening 72 and the ring serves to fill a clearance between the fuel tank 7 and the cover member 2 in order to reduce or eliminate the clearance.

As shown in FIGS. 1 and 2, the pump unit 4 is arranged below the cover member 2. The pump unit 4 includes the pump 41 used for feeding fuel and a base portion 42 used for mounting the pump 41. The base portion 42 has a substantially flat plate shape and is arranged so that one surface of the base portion 42 faces the bottom surface 73 of the fuel tank 7.

The base portion 42 may also be referred to as a fuel reservoir or a sub-tank etc. The base portion 42 includes an upper base 421 to which the pump 41 is attached, a lower base 422 which faces and contacts the bottom surface 73 of the fuel tank 7, and a filter member 423 which is interleaved between the upper base 421 and the lower base 422. The upper base 421 is provided with a suction port (not shown) to be connected with the pump 41 and configured such that the fuel passed through the filter member 423 can be sucked by the pump 41. A periphery of the filter member 423 is formed as a suction portion. The lower base 422 has an opening (bottom surface opening 4221) with a lattice. The lower base 422 comprises clearance providing leg portions 4222 so that the fuel can be sucked from the bottom surface opening even when the lower base 422 is abutting the bottom surface 73 of the fuel tank 7. The leading ends of the leg portions 4222 form the bottom portion of the suction portion.

Figure 5:
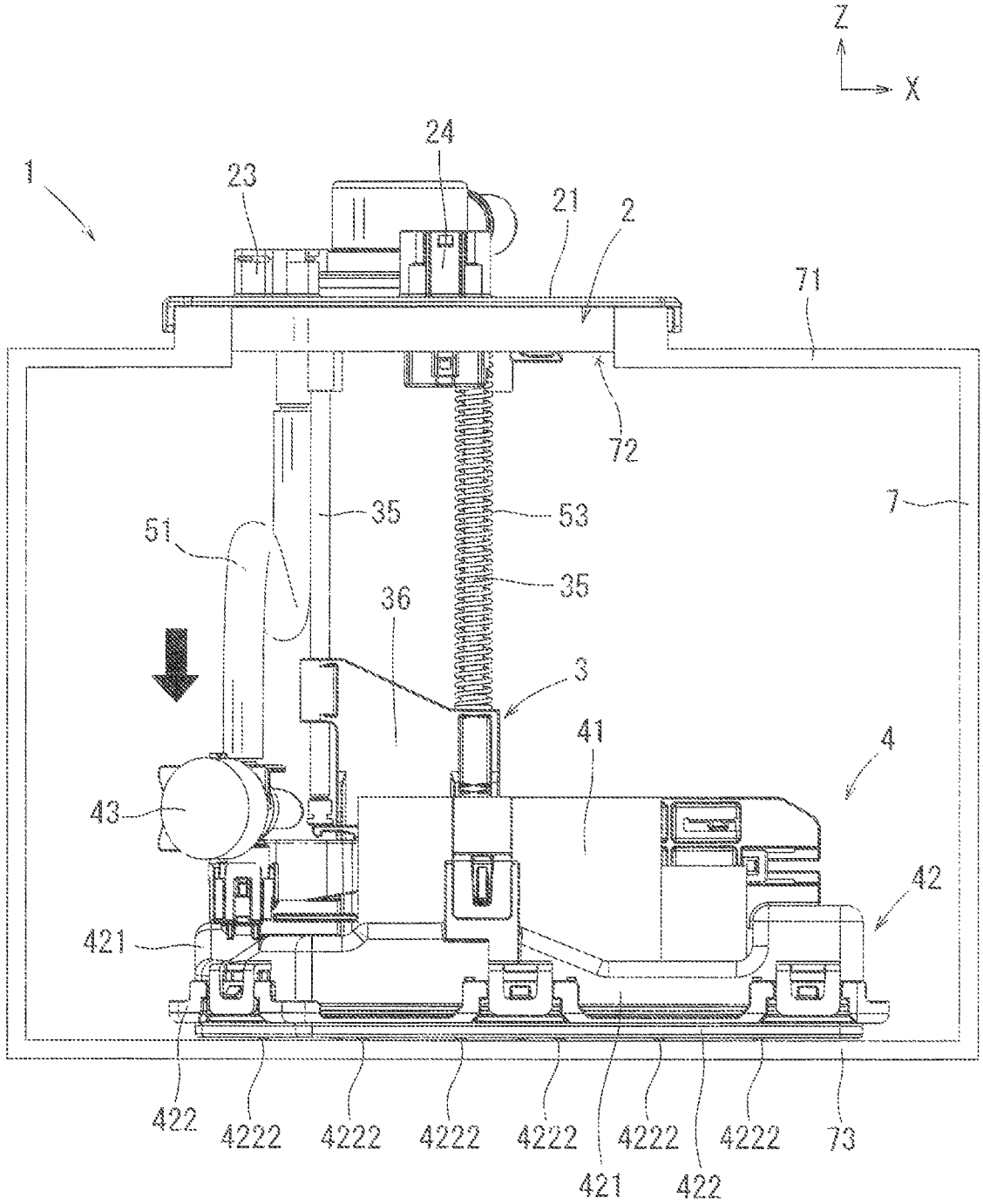
FIG. 5 is a right side view of the fuel supply device of FIG. 1 attached to a fuel tank.

As shown in FIGS. 1, 2 and 5, a pressure control valve 43 used for adjusting liquid feed pressure of the fuel is attached to the pump unit 4. The pressure control valve 43 is attached to a valve supporting portion 411 extending from the pump 41. The fuel with adjusted pressure by the pressure control valve 43 is fed to the internal combustion engine, for example, via a hose 51 and the outlet port 23.

As shown in FIG. 2, according to the fuel supply device 1, an engagement portion 49 is provided at the lower base 422 of the base portion 42. The engagement portion 49 is configured to have a substantially flat plate shape which extends in a direction perpendicular to the lateral surface of the base portion proximal to the connection portion, where the surface **49*b* is coplanar with the leading ends of the leg portions 4222 which are provided at the lower base 422. A surface 49*a*, which can be engaged with the connecting portion 3, is formed on the opposite side of the one surface 49*b* as shown in FIG. 2. The connecting portion 3 is maintained in an abutting state, where it abuts the surface 49*a*, by shortening the distance between the cover member 2 and the pump unit 4 as the cover member 2 is pressed. During this time, the spring 53 disposed adjacent to the connecting portion 3 is compressed and a restoring force of the spring 53 for attempting to return into its original shape is transmitted to the bottom surface 73 of the fuel tank 7 via the engagement portion 49. In this way, through the transmission of force from said restoring force, the engagement portion 49 can be maintained in a pressed state against the bottom surface 73 of the fuel tank 7**.

As shown in FIG. 2, a distance from a surface **49*a* of the engagement portion 49 which can abut the connecting portion 3, to the bottom surface 73 of the fuel tank 7 is configured to be shorter than a distance from the center of gravity of the pump unit 4 to the bottom surface 73 of the fuel tank 7 when the fuel supply device 1 is mounted to the fuel tank 7. Accordingly, this configuration enables the pump unit 4 to be pressed in a position closer to the bottom surface 73 of the fuel tank 7 than the center of gravity of the pump unit 4. Therefore, the pump unit 4 is hardly influenced by the oscillation or the inclination of the fuel tank 7 such that it can be efficiently maintained in a stable abutted state with the bottom surface 73 of the fuel tank 7**.

As shown in FIG. 2 with reference to the engagement portion 49, the surface 49*b* oppositely facing the bottom surface 73 of the fuel tank 7 and the surface 49*a* oppositely facing the connecting portion 3 are both configured to be planar surfaces. Therefore, because of the planar configuration the force applied by the connecting portion 3 can be received by a relatively broad surface area and the force can be transmitted further through a relatively broad surface area with respect to the bottom surface 73 of the fuel tank 7. As a result, through efficient force transfer the pump unit 4 can abut the bottom surface 73 of the fuel tank 7 in a more stable manner.

As shown in FIG. 2, the surface 49*b* of the engagement portion 49 facing downward against the bottom surface 73 of the fuel tank 7 is coplanar with the leading ends of the leg portions 422. Therefore, the engagement portion 49 may abut the bottom surface 73 of the fuel tank 7 and the leg portions 4222 may also abut the bottom surface 73 of the fuel tank 7. As a result, with both components abutting the bottom surface 73, the pump unit 4 can abut the bottom surface 73 of the fuel tank 7 in a more stable state.

As shown in FIG. 2, the engagement portion 49 is integrally formed with the pump unit 4 so as to not be separated when molding the lower base 422 at the base portion 42, and is made by injection molding. In other words, the engagement portion 49 is molded during the molding of the bottom portion of the suction portion. Therefore, it is molded without requiring any additional process, such as attaching a separate additional engagement portion 49 to the pump unit 4.

As shown in FIG. 2, the connecting portion 3 which abuts the engagement portion 49 extends in a direction orthogonal to a plane in which the set plate portion 21 of the cover member 2 extends radially, and the connecting portion 3 may also move orthogonal to the plane in which the set plate portion 21 extends. Since one end i.e., a lower end of the connecting portion 3 is configured to about the surface 49*a* of the engagement portion 49, where the abutment transfers force, the force generated between the pump unit 4 and the connecting portion 3 is prevented from acting as a moment for bending the connection portion 3. Consequently, the force generated between the pump unit 4 and the connecting portion 3 may easily act through the force transfer described above to maintain the pump unit 4 in a stable abutted state against the fuel tank 4.

More specifically, as shown in FIGS. 2 and 5, the connecting portion 3 of the fuel supply device 1 is telescopic, and can be extended and retracted. The connecting portion 3 includes a rod member 35 attached to the cover member 2 and a joint portion 36 which is movable along the length of rod member 35. The rod member 35 extends in a direction orthogonal to the plane in which the set plate portion 21 extends radially. Further, a spring 53 that can exert elastic force is arranged as a biasing member between the joint portion 36 and the cover member 2. The spring 53 biases the cover member 2 to move away and be spaced apart from the pump unit 4 when the cover member 2 and the pump unit 4 mutually approach closer than a predetermined distance. In this manner, the spring 53 is compressed while the cover member 2 is moved towards the bottom surface 73 of the fuel tank 7 from an existing state in which the bottom surface of the pump unit 4 contacts the bottom surface 73 of the fuel tank 7. As long as this compressed state of the spring 53 is maintained, the pressed state of the pump unit 4 against the bottom surface 73 will also be maintained.

Figure 3:
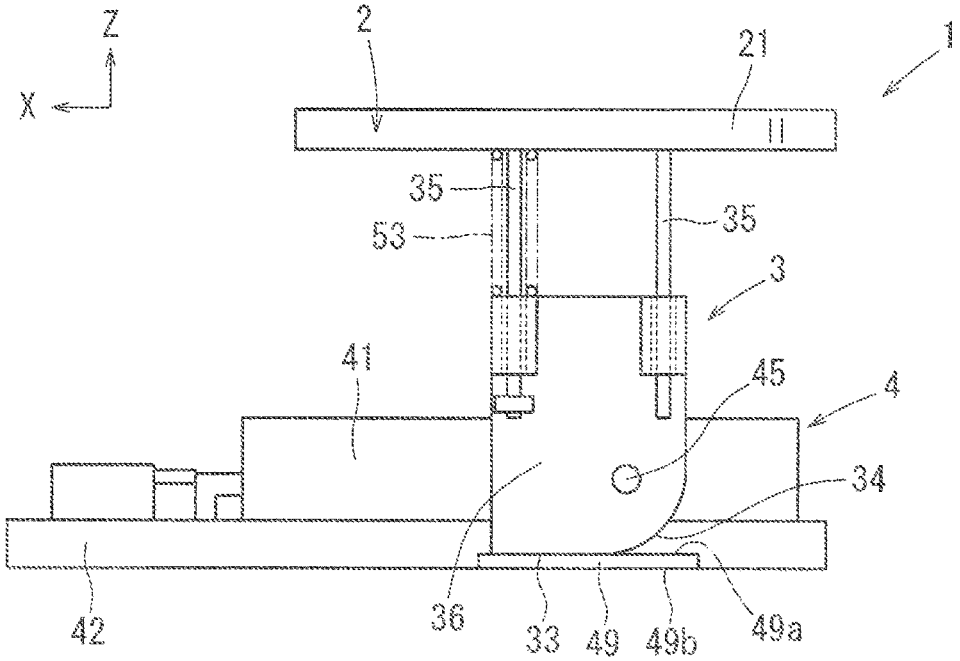
FIG. 3 is a schematic left side view of the fuel supply device of FIG. 1.

As shown in FIG. 3, a curved surface 34 is formed at a corner of the lower backward end of the connecting portion 3. The curved surface 34 is formed on the rear side of the connecting portion 3. This curved surface 34 is formed so as to draw a circular arc shape in a side view as seen from the left side. In particular, it is configured such that the central axis of the connecting hole 31 in the Y direction, as viewed in the XZ plane, corresponds to the center of the circular arc at the curved surface 34. Therefore, due to this configuration where the central axis corresponding to hole 31 and shaft 45 forms the center of a circular arc relative to the curved surface, the distance from the connecting portion 3 to the engagement portion 49 does not change even when the pump unit 4 is rotated about the connecting shaft 45. As a result, the tangentially adjacent positional relation in which the connecting portion 3 is located relative to the engagement portion 49, may be maintained. In contrast, a front surface at the lower end of the connecting portion 3 is not formed in a circular arc shape but is rather formed as a planar surface 33, and extends substantially parallel to both the surfaces in which the engagement portion 49 and set plate portion 21 extend. When the fuel supply device 1 is mounted to the fuel tank 7, the engagement portion 49 usually abuts this planar surface 33.

Figure 4:
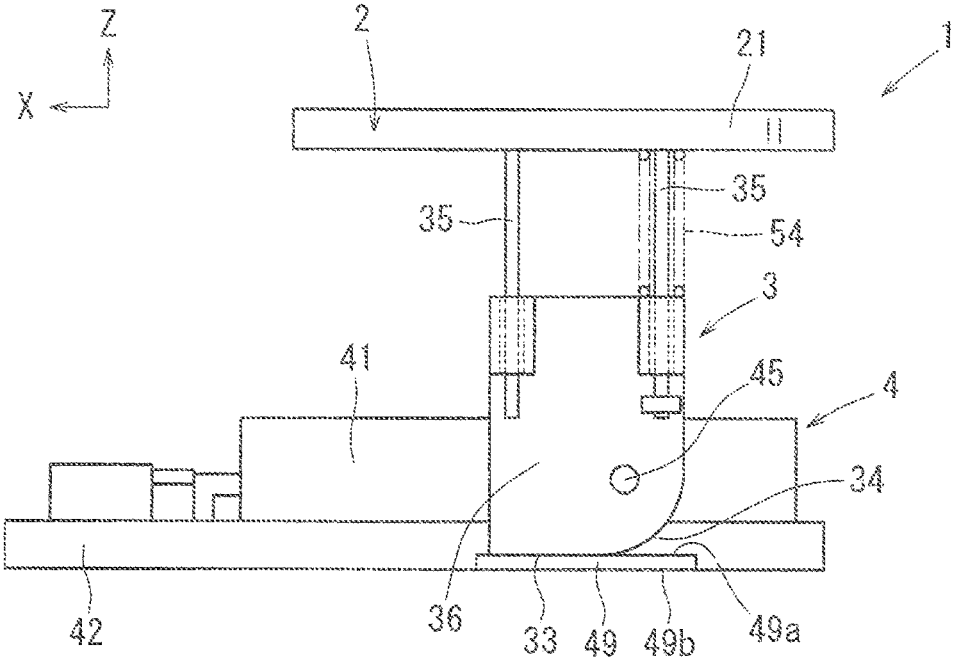
FIG. 4 is a schematic left side view of a fuel supply device according to another embodiment.

As shown in FIG. 3, the spring 53 is arranged at front side rather than the center of the connecting shaft 45. In particular, the spring 53 is arranged so as to cover the outer periphery of the rod member 35 which is arranged at the front side rather than the center relative to the connecting shaft 45. The biasing force of the spring 53 is applied from above the planar surface 33 to the surface 33. Therefore, by being arranged towards the front relative to shaft 45, the biasing force from the spring 53 is applied on the front side of the planar surface 33, and is not applied on the side of curved surface 34. Consequently, the biasing force from the spring 53 can be efficiently transmitted through 33 to the engagement portion 49. Alternative to or in addition to the spring 53, a spring 54 may be arranged behind the center of the connecting shaft 45 as shown in FIG. 4. The spring 54, which is arranged directly above the curved surface 34, may also press the pump unit 4 against the bottom surface 73 of the fuel tank 7 because of its relationship relative to the fuel tank 7 via curved surface 34. However, in view of the efficient transfer of the biasing force of spring 53, it is favorable to arrange the spring 53 directly above the planar surface 33 as shown in FIG. 3.

According to the embodiment shown in FIGS. 2 and 5, the device is configured such that the fuel pump 41 is pressed against the bottom surface 73 of the fuel tank 7 using downwards reaction force of a hose 51, which is bent within the fuel tank 7, in addition to the biasing force of the spring 53 (see an arrow in FIG. 5). Because of this configuration, the pump unit 4 can be efficiently maintain a stable abutted state against the bottom surface 73 of the fuel tank 7.

A method for mounting the fuel supply device 1 to the fuel tank 7 according to the embodiments shown in FIGS. 1 to 3 and 5 will be described as follows. The opening 72 is usually formed at one part of an upper surface 71 of the fuel tank 7, which is formed to be parallel to the bottom surface 73. The pump unit 4 of the fuel supply device 1 is first inserted from the opening 72 into the fuel tank 7 in order to press the set plate portion 21 of the cover member 2 against the opening 72 so that the pump unit 4 is thereby pressed against the bottom surface 73 of the fuel tank 7, and then the cover member 2 is attached to the opening 72.

Referring to FIG. 2, one end of the pump unit 4 first enters into the opening 72 when attempting to attach the fuel supply device 1 to the opening 72. If the cover member 2 is made to be parallel to the upper surface 71 of the fuel tank 7 and held in this position when the pump unit 4 is received within the fuel tank 7, the pump unit 4 will be inclined relative to the bottom surface 73 of the fuel tank 7, e.g. in a state as shown in FIG. 1 through the operation of a not shown rotation restricting mechanism. The pump unit 4 abuts the fuel tank 7 when the cover member 2 of the fuel supply device 1 is moved to be attached to the opening 72, and is further pressed so as to move downwardly. Consequently, through said downward movement and by virtue of being in a contained tank, the bottom surface of the pump unit 4 moves (rotates) about shaft 45 to oppose and abut the bottom surface 73 of the fuel tank 7. In this case, before the cover member 2 is further pressed, the plane in which the base portion 42 extends intersects the bottom surface 73 of the fuel tank 7 at the front portion of base portion 42 while being inclined relative to the fuel tank 7. Then, the position of the backward end of the pump unit 4 and the position in which the connecting shaft 45 is arranged, proximal to said backward end, are then displaced downwards in a plan view as the cover member 2 is further pressed. Thus, it is only necessary to press the fuel supply device 1 downwards by the cover member 2 in order to allow the pump unit 4 to rotate about the connecting shaft 45, and abut bottom surface 73.

As shown in FIGS. 2 and 5, as the cover member 2 is moved further downward from a position where the pump unit 4 lies flush against the bottom surface 73 of the fuel tank 7, biasing force is exerted to space the connecting portion 3 further apart from the cover member 2. In particular, through said biasing force, the connecting portion 3 is pressed against the engagement portion 49, and in turn the engagement portion 49 is pressed against the fuel tank 7. In order for the force applied to the connecting portion 3 to be transmitted to the engagement portion 49, it is only necessary that the end portion of the connecting portion 3 abuts the engagement portion 49.

According to the embodiments shown in FIGS. 1 to 5, the engagement portion 49 is provided at the lower base 422 of the pump unit 4. More specifically, the device is configured such that a plate-like portion extends laterally from the lower end of the lower base 422. Therefore, through this configuration, the biasing force is able to press the pump unit 4 against the bottom surface 73 of the fuel tank 7, and through the plate-like structure of the engagement portion 49, the pump unit 4 is prevented from being inclined when this engagement portion 49 is pressed by the connecting portion 3. Further, the device is configured such that clearance is formed between the bottom portion opening of the pump unit 4 and the bottom surface 73 of the fuel tank 7 even when the engagement portion 49 and the leg portions 4222 abut the bottom surface 73 of the fuel tank 7. This clearance enables the pump unit 4 to be pressed against the bottom surface 73 of the fuel tank 7 even while preserving a state where the fuel can be sufficiently sucked from the bottom portion opening of the pump unit 4 provided by said clearance.

The embodiment shown in FIG. 6 will be described as follows. The major differences between the embodiment shown in FIG. 6 and the embodiments as shown in FIGS. 1 to 5 are the configurations of the cover member 2 and the connecting portion 3. Therefore, these differences will be mainly described below. The cover member 2 shown in FIG. 6 includes a canister portion 27 filled with an adsorbent at the lower part of the set plate portion 21. Further, the canister portion 27 includes a first slide portion 38 provided at the connecting portion 3 and a second slide portion 28 which can slide relative to the first slide portion 38. A spring 53 is arranged between the upper end of the connecting portion 3 and the set plate portion 21. The biasing force by the cover member 2 on the spring 53 can be exerted to space the connecting portion 3 apart from the cover member 2 when the connecting portion 3 and the cover member 2 mutually approach closer than a predetermined distance.

Figure 6:
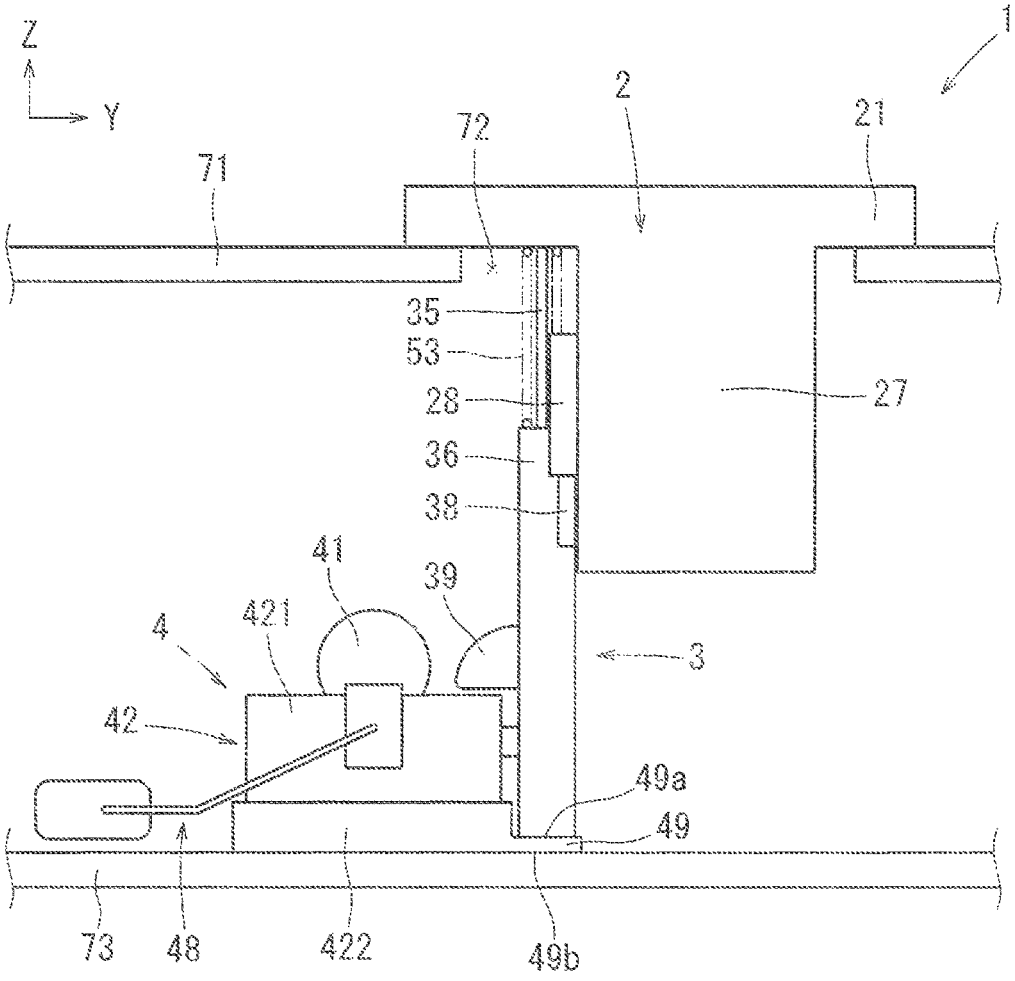
FIG. 6 is a schematic front view of a fuel supply device according to another embodiment.

As shown in FIG. 6, the engagement portion 49 is provided at the lower base 422 of the pump unit 4. An arm 39 is formed at a lateral surface of the connecting portion 3 so as to be capable of abutting the upper base 421 of the pump unit 4. The pump unit 4 can be pressed additionally by the arm 39 so that the pump unit 4 can be pressed against the bottom surface 73 of the fuel tank 7 more efficiently.

Figure 7:
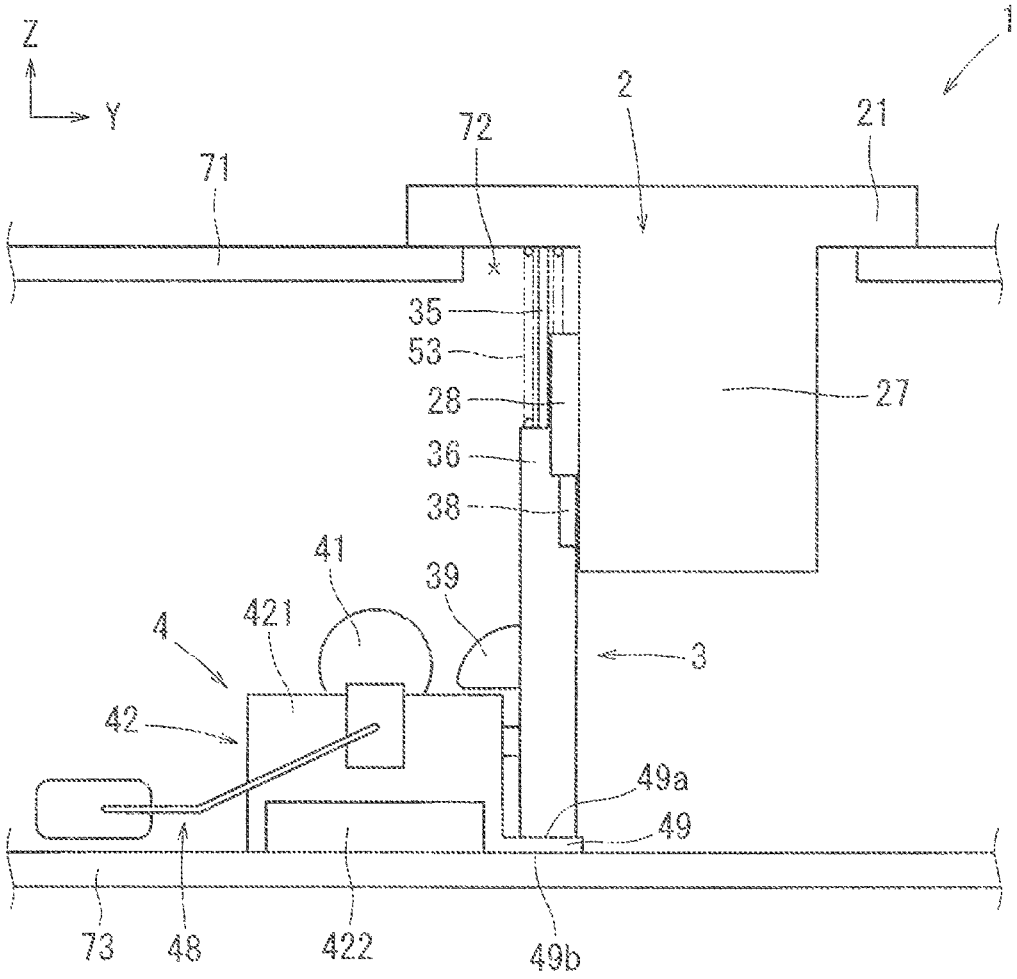
FIG. 7 is a schematic front view of a fuel supply device according to another embodiment.

The embodiment shown in FIG. 7 will be described as follows. The major difference between the embodiment shown in FIG. 7 and the embodiment shown in FIG. 6 is the configuration of the base portion 42. Therefore, this difference will be mainly described below. The engagement portion 49 shown in FIG. 7 is provided at the upper base 421. In particular, the base portion 42 is formed to extend from the lateral surface of the upper base 421 so as to be pressed against the bottom surface 73 of the fuel tank 7 by the lower end of the connecting portion 3. The engagement portion 49 is formed as a part of the upper base 421 and resin molded such that the engagement portion 49 is included in the entire upper base 421.

As shown in FIG. 7, the lower end of the upper base 421 is configured to be coplanar with the lower end of the lower base 422 such that one surface **49*b* of the engagement portion 49 can abut the bottom surface 73 of the fuel tank 7. Alternatively, it is not necessary to arrange the lower end of the upper base 421 to be on the same plane as the lower end of the lower base 422 but the lower end of the upper base 421 may also be arranged below the lower end of the lower base 422, such that it abuts the bottom surface 73**.

Figure 8:
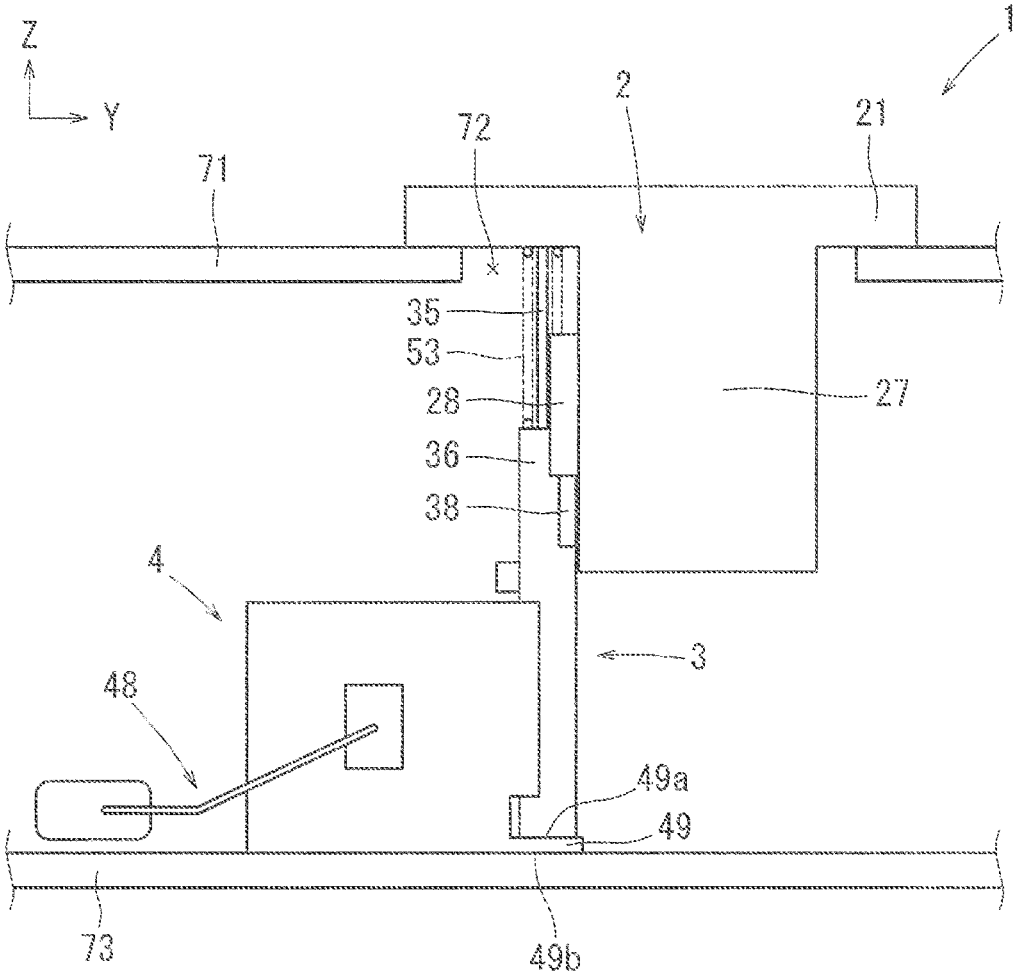
FIG. 8 is a schematic front view of a fuel supply device according to another embodiment.

The embodiment shown in FIG. 8 will be described as follows. In contrast to the other embodiments, the pump unit 4 of the embodiment shown in FIG. 8 is configured to be unrotatable relative to the connecting portion 3. In particular, the engagement portion 49 formed at the pump unit 4 and the lower part of the connecting portion 3 are arranged in a position where they always oppose to and contact each other. The pump unit 4 is configured to have the pump 41 received in a cup-shaped cover (not shown). Also with this fuel supply device 1, the pump unit 4 may abut the fuel tank 7 in a stable state when the engagement portion 49 is abutted to the connecting portion 3 at the lower part of the fuel supply device 1.

With reference to the pump unit 4 according to the embodiment shown in FIG. 8, the pump unit 4 is connected to the connecting portion 3 so as to be collectively linearly movable in upward and downward directions via the slide portions 28 and 38. Alternatively, the pump unit 4 and connecting portion 3 may also be immovably connected.

Figure 9:
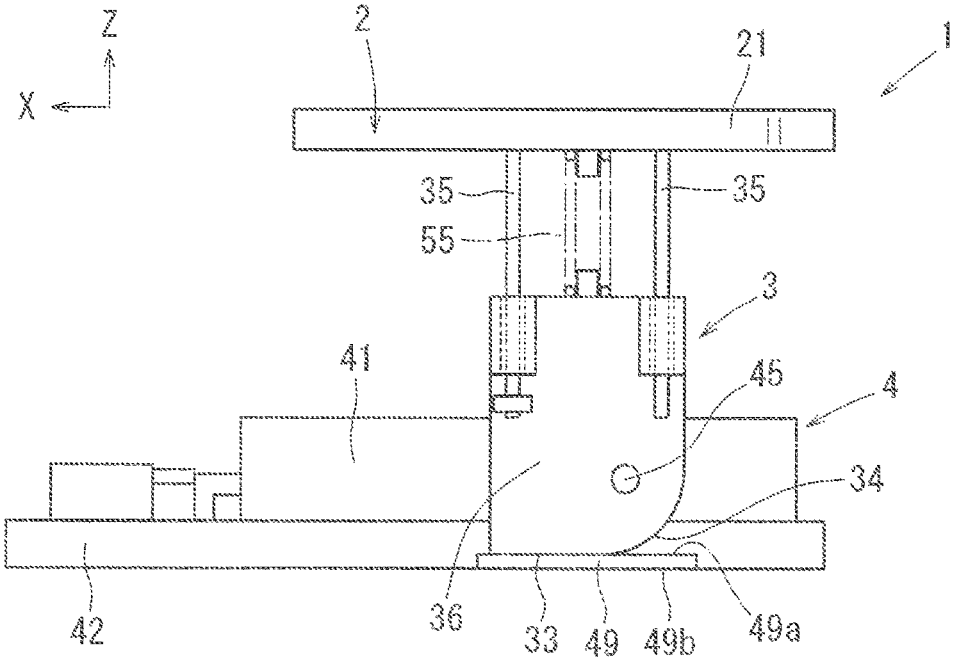
FIG. 9 a schematic left side view of a fuel supply device according to another embodiment.

The embodiment shown in FIG. 9 will be described as follows. The major difference between the embodiment shown in FIG. 9 and the embodiments shown in FIGS. 1 to 5 is the position of the spring. Therefore, this difference will be mainly described below. The springs 53 and 54 according to the embodiment shown in FIGS. 1 to 5, are arranged to cover an outer circumferential periphery of the rod member 35 which serves to connect the joint portion 36 and the set plate portion 21. In contrast, a spring 55 according to the embodiment shown in FIG. 9 is arranged between two rod members 35 in the X direction. Also in the embodiment shown in FIG. 9, the spring 55 is arranged on the front side relative to the center of the connecting shaft 45. Further, a horizontal XY plane that comprises the top of lower end of the connecting portion 3, which is positioned directly below the spring, is formed to be planar such that the biasing force of the spring 55 can be efficiently transmitted through the lower end of the connecting portion 3 to the engagement portion 49.

Though the embodiment shown in FIG. 9 includes only one spring 55, the number of the spring 55 does not have to be limited to only one, and can comprise a plurality of springs. For example, at least one of the springs 53 and 54 shown in FIGS. 3 and 4 may also be arranged in addition to the spring 55.

While the embodiments of invention have been described with reference to specific configurations, it will be apparent to those skilled in the art that many alternatives, modifications and variations may be made without departing from the scope of the present invention. Accordingly, embodiments of the present invention are intended to embrace all such alternatives, modifications and variations that may fall within the spirit and scope of the appended claims. Embodiments of the present invention should not be limited to the representative configurations, but may be modified, for example, as described below.

For example, the engagement portion may also be configured as a separate member from the lower base.

The engagement portion does not have to have a completely flat shape but it is also possible to have a recessed shape or protruding shape.

The connecting portion may be formed to also have a curved surface at a lower front end, or to have an inclined surface instead of a curved surface. Also, in this case, the biasing member is preferably arranged directly above a flat surface portion of the connecting portion which abuts the engagement portion.

If it is possible to maintain the pump unit in an abutted state with the bottom surface of the fuel tank only by the reaction force of the hose 51 which is arranged between the cover member and the pump unit, it is not necessary to configure the device to have the lower part of the connecting portion is abutting the engagement portion.

It is not necessary to have the filter member at the base portion. Therefore, it is possible to configure the device without the filter member. In this case, the filter member may be arranged at any other portion of the device than the base portion. Furthermore, if the fuel to be sucked by the pump is maintained clean, the filter member itself does not have to be present in the fuel supply device.

The configuration for movably connecting the connecting portion relative to the pump unit is not limited to the connection by inserting the connecting shaft formed as part of the pump unit into the connecting hole formed as part of the connecting portion. Alternatively, it is also possible to configure said connection by inserting the connecting shaft formed as part of the connecting portion into the connecting hole formed as part of the pump unit.

Moreover, as per the vehicle, the invention is not limited in scope to automobiles. It may also be used in a vehicle that flies in the air (e.g. an airplane or a helicopter), or that moves over the sea or in the sea (e.g. a ship or a submarine).

The invention claimed is:

1. A fuel supply device comprising:

a cover member which is attachable to an opening of a fuel tank; and a pump unit comprising a pump;

a connecting portion for connecting the cover member and the pump unit wherein the pump unit is connected to the connecting portion so as to be movable with respect to the cover member; and an engagement portion provided at a lower portion of the pump unit, abutting the connecting portion when the fuel supply device is attached to the fuel tank, such that via the engagement portion, the connecting portion presses the pump unit against the fuel tank, wherein the pump unit is connected so as to be movable with respect to the connecting portion when a connecting shaft which is part of one of the connecting portion or the pump unit, is inserted into a connecting hole which is part of the other of the connecting portion or the pump unit; and a planar surface at a lower end of the connecting portion, wherein the engagement portion includes a planar surface opposing the planar surface of the connecting portion when the fuel supply device is assembled to the fuel tank.

2. The fuel supply device of claim 1, wherein the engagement portion includes a bottom surface which is formed on the same plane as a bottom surface of a suction portion of the pump unit.

3. The fuel supply device of claim 1, wherein the engagement portion is integrally formed with a bottom portion of a suction portion provided at the pump unit.

4. The fuel supply device of claim 1, wherein the lower end of the connecting portion comprises a bottom surface which includes a flat planar surface as well as a curved surface extending from the flat planar surface having a circular arc shape in a side view, wherein the curved surface is formed at a corner of the lower end of the connecting portion, while a center of the circular arc of the curved surface corresponds to a central axis of the connecting hole.

5. The fuel supply device of claim 4, further comprising a biasing member which is arranged directly above the planar surface of the connecting portion, where said biasing member biases the connecting portion to provide a pressing force onto the engagement portion.

6. The fuel supply device of claim 4, wherein the flat planar surface of the bottom surface of the lower end of the connecting portion has a rectangular shape in the XY plane that has a width wider than the width of the curved surface.

7. A fuel supply device comprising:

a cover member which is attachable to an opening of a cuboid-shaped fuel tank;

a pump unit comprising a pump and a base portion, wherein the base portion comprises an upper base and lower base portion, wherein the upper base is provided with a suction port connected with the pump, and the lower base comprises an opening with a lattice, such that fuel can be sucked through the suction port to the pump;

a connecting portion for connecting the cover member and the pump unit wherein the pump unit is connected to the connecting portion so as to be relatively movable with respect to both the connecting portion and the cover member through a composite structure comprising a connecting shaft inserted into a connecting hole, wherein the shaft is formed as part of one of the connecting portion or the pump unit, and the connecting hole is formed as part of the other of the two; and an engagement portion provided at a lower portion of the pump unit, where when the fuel supply device is attached to the cuboid-shaped fuel tank where the cover member of the device may be affixed to an opening at the upper surface of such a tank, the engagement portion of the device touches the bottom of the fuel tank, where said portion comprises a top surface which is planar in the XY plane abutting the connecting portion as well as a bottom surface also planar in the XY plane and abutting the bottom of the fuel tank, such that via the engagement portion, the connecting portion of the device presses the pump unit against the bottom of the fuel tank, wherein a planar bottom surface comprising at least a rectangular portion at its front side parallel to the XY plane is formed at the lower end of the connecting portion, and when the fuel supply device is assembled to the fuel tank, the top planar surface of the engagement portion is vertically opposed to the planar bottom surface of the connecting portion.

8. The fuel supply device of claim 7, wherein the engagement portion is part of the upper base of the pump unit.

9. The fuel supply device of claim 7, wherein the engagement portion is part of the lower base of the pump unit.

10. The fuel supply device of claim 9, wherein the engagement portion extends in a direction perpendicular to the lateral surface of the base portion proximal to the connection portion lying in the XZ plane.

11. The fuel supply device of claim 7, wherein the engagement portion bottom surface is coplanar with leg portions at the bottom of the lower base of the pump unit, wherein said leg portions provide clearance enabling the pump unit to be pressed against the bottom surface of the fuel tank even while fuel may be sucked from the area below the XY plane of the bottom of the lattice formed at the lower base, such that fuel with drawn from this space can be sucked by the pump through the suction port of the upper base.

12. The fuel supply device of claim 7, wherein a circular arc shape is formed and extends from the backward end of the planar bottom surface of the connecting portion forming a curved surface from the backwards negative X direction to the upwards Z direction in the XZ plane, configured such that the central axis of the connecting hole of the connection portion extends in the Y direction, and forms the center of the circular arc relative to the curved surface, wherein this curved surface enables the tangentially adjacent positional relation in which the connecting portion is located relative to the engagement portion to be maintained regardless of rotation of the pump unit about the connection shaft, when the device is assembled to the cuboid-shaped fuel tank.

13. The fuel supply device of claim 7, further comprising a biasing member which is arranged directly above the planar surface of the connecting portion towards the front side, where said biasing member biases the connecting portion to provide a pressing force onto the engagement portion without applying biasing force to any curved surface.

14. The fuel supply device of claim 7, further comprising a biasing member which is arranged directly above the planar surface of the connecting portion towards the back side, where said biasing member biases the connecting portion to provide a pressing force onto the engagement portion including applying biasing force to a curved surface.

15. A fuel supply device comprising:

a cover member which is attachable to an opening of a cuboid-shaped fuel tank;

a pump unit comprising a pump and a base portion, wherein the base portion comprises an upper base and lower base, wherein the upper base is provided with a suction port connected with the pump, and the lower base comprises an opening with a lattice, such that fuel can be sucked through the suction port to the pump;

a connecting portion for connecting the cover member and the pump unit wherein when the cover member is attached to the opening of the tank, said portion comprises a hose with a compressed kink lying in the YZ plane such as to apply a downwards force on the pump unit against the bottom of the fuel tank, where the pump unit is connected to the connecting portion so as to be relatively movable with respect to both the connecting portion and the cover member through a composite structure comprising a connecting shaft inserted into a connecting hole, wherein the shaft is formed as part of one of the connecting portion or the pump unit, and the connecting hole is formed as part of the other of the two; and a planar bottom surface comprising at least a rectangular portion at its front side parallel to the XY plane which is at the lower end of the connecting portion, such that when the fuel supply device is assembled to the fuel tank, the kink of the hose generates sufficient downward force to maintain the bottom surface of the lower base of the pump unit pressed against the bottom of the fuel tank.

* * * * *